US008468024B2

(12) United States Patent
Susan et al.

(10) Patent No.: US 8,468,024 B2
(45) Date of Patent: Jun. 18, 2013

(54) GENERATING A FRAME OF AUDIO DATA

(75) Inventors: Adrian Susan, Orastie (RO); Mihai Neghina, Craiova (RO)

(73) Assignee: Freescale Semiconductor, Inc., Austin, TX (US)

( * ) Notice: Subject to any disclaimer, the term of this patent is extended or adjusted under 35 U.S.C. 154(b) by 678 days.

(21) Appl. No.: 12/599,137

(22) PCT Filed: May 14, 2007

(86) PCT No.: PCT/IB2007/051818

§ 371 (c)(1), (2), (4) Date: Nov. 6, 2009

(87) PCT Pub. No.: WO2008/139270

PCT Pub. Date: Nov. 20, 2008

(65) Prior Publication Data

US 2010/0305953 A1 Dec. 2, 2010

(51) Int. Cl.
*G10L 19/00* (2006.01)

(52) U.S. Cl.
USPC ..... 704/500; 704/200; 704/206

(58) Field of Classification Search
USPC ..... 704/211, 223, 216, 217, 218, 209, 704/200, 206, 207, 224, 500
See application file for complete search history.

(56) References Cited

U.S. PATENT DOCUMENTS

| | | | | |
|---|---|---|---|---|
| 6,952,668 | B1 * | 10/2005 | Kapilow | 704/206 |
| 7,587,315 | B2 * | 9/2009 | Unno | 704/223 |
| 7,590,525 | B2 * | 9/2009 | Chen | 704/211 |
| 2005/0049853 | A1 | 3/2005 | Lee et al. | |

FOREIGN PATENT DOCUMENTS

| | | | |
|---|---|---|---|
| EP | 1722359 | A | 11/2006 |
| EP | 1724756 | A | 11/2006 |

OTHER PUBLICATIONS

Elsabrouty M et al: "A New Hybrid Long-Term and Short-Term Prediction Algorithm for Packet Loss Erasure Over IP-Networks" Signal Processing and its Applications, 2003. Proceedings. Seventh International Symposium on Jul. 1-4, 2003, Piscataway, NJ, vol. 1, Jul. 1, 2003, pp. 361-364.

Perkins C et al: "A Survey of Packet Loss Recovery Techniques for Streaming Audio" IEEE Network, IEEE Service Center, New York, NY, US Sep. 1998, pp. 40-48.

Choi A W et al: "Effects of Packet Loss on 3 Toll Quality Speech Coders" Second IEE National Conference on Telecommunications, 1989, pp. 380-385.

Mihai Neghina: "Signals for Detecting the Use of 0-Delay PLC in Black Boxes", Feb. 9, 2007.

(Continued)

*Primary Examiner* — Huyen X. Vo

(57) ABSTRACT

A method of generating a frame of audio data for an audio signal from preceding audio data for the audio signal that precede the frame of audio data, the method comprising the steps of: predicting a predetermined number of data samples for the frame of audio data based on the preceding audio data, to form predicted data samples; identifying a section of the preceding audio data for use in generating the frame of audio data; and forming the audio data of the frame of audio data as a repetition (602) of at least part of the identified section to span the frame of audio data, wherein the beginning of the frame of audio data comprises a combination of a subset of the repetition (602) of the at least part of the identified section and the predicted data samples.

12 Claims, 9 Drawing Sheets

OTHER PUBLICATIONS

Ondria J. Wasem et. al.: "The Effect of Waveform Substitution on the Quality of PCM Packet Communications", IEEE Transactions on Acoustics, Speech, and Signal Processing, vol. 36, No. 3, Mar. 1988, pp. 342-348.

International Search Report and Written Opinion correlating to PCT/IB2007/051818 dated Feb. 25, 2008.

"G.711" printed from <<http://en.wikipedia.org/wiki/G.711>>on Oct. 9, 2012, 5 pages.

* cited by examiner

GENERATING A FRAME OF AUDIO DATA

FIELD OF THE INVENTION

The present invention relates to a method, apparatus and computer program of generating a frame of audio data. The present invention also relates to a method, apparatus and computer program for receiving audio data.

BACKGROUND OF THE INVENTION

FIG. 1 of the accompanying drawings schematically illustrates a typical audio transmitter/receiver system having a transmitter 100 and a receiver 106. The transmitter 100 has an encoder 102 and a packetiser 104. The receiver 106 has a depacketiser 108 and a decoder 110. The encoder 102 encodes input audio data, which may be audio data being stored at the transmitter 100 or audio data being received at the transmitter 100 from an external source (not shown). Encoding algorithms are well known in this field of technology and shall not be described in detail in this application. An example of an encoding algorithm is the ITU-T Recommendation G.711, the entire disclosure of which is incorporated herein by reference. An encoding algorithm may be used, for example, to reduce the quantity of data to be transmitted, i.e. a data compression encoding algorithm. The encoded audio data output by the encoder 102 is packetised by the packetiser 104. Packetisation is well known in this field of technology and shall not be described in further detail. The packetised audio data is then transmitted across a communication channel 112 (such as the Internet, a local area network, a wide area network, a metropolitan area network, wirelessly, by electrical or optic cabling, etc.) to the receiver 106, at which the depacketiser 108 performs an inverse operation to that performed by the packetiser 104. The depacketiser 108 outputs encoded audio data to the decoder 110, which then decodes the encoded audio data in an inverse operation to that performed by the encoder 102.

It is known that data packets (which shall also be referred to as frames within this application) can be lost, missed, corrupted or damaged during the transmission of the packetised data from the transmitter 100 to the receiver 106 over the communication channel 112. Such packets/frames shall be referred to as lost or missed packets/frames, although it will be appreciated that this term shall include corrupted or damaged packets/frames too. Several existing packet loss concealment algorithms (also known as frame erasure concealment algorithms) are known. Such packet loss concealment algorithms generate synthetic audio data in an attempt to estimate/simulate/regenerate/synthesise the audio data contained within the lost packet(s).

One such packet loss concealment algorithm is the algorithm described in the ITU-T Recommendation G.711 Appendix 1, the entire disclosure of which is incorporated herein by reference. This packet loss concealment algorithm shall be referred to as the G.711(A1) algorithm herein. The G.711(A1) algorithm shall not be described in full detail herein as it is well known to those skilled in this area of technology. However, a portion of it shall be described below with reference to FIGS. 2 and 3 of the accompanying drawings. This portion is described in particular at sections I.2.2, 1.2.3 and I.2.4 of the ITU-T Recommendation G.711 Appendix 1 document.

FIG. 2 is a flowchart showing the processing performed for the G.711(A1) algorithm when a first frame has been lost, i.e. there has been one or more received frames, but then a frame is lost. FIG. 3 is a schematic illustration of the audio data of the frames relevant for the processing performed in FIG. 2.

In FIG. 3, vertical dashed lines 300 are shown as dividing lines between a number of frames 302*a-e* of the audio signal. Frames 302*a-d* have been received whilst the frame 302*e* has been lost and needs to be synthesised (or regenerated). The audio data of the audio signal in the received frames 302*a-d* is represented by a thick line 304 in FIG. 3. In a typical application of the G.711(A1) algorithm, the audio data 304 will have been sampled at 8 kHz and will have been partitioned/packetised into 10 ms frames, i.e. each frame 302*a-e* is 80 audio samples long. However, it will be appreciated that other sampling frequencies and lengths of frames are possible. For example, the frames could be 5 ms or 20 ms long and could have been sampled at 16 kHz The description below with respect to FIGS. 2 and 3 will assume a sampling rate of 8 kHz and that the frames 302*a-e* are 10 ms long. However, the description below applies analogously to different sampling frequencies and frame lengths.

For each of the frames 302*a-e*, the G.711(A1) algorithm determines whether or not that frame is a lost frame. In the scenario illustrated in FIG. 3, after the G.711(A1) algorithm has processed the frame 302*d*, it determines that the next frame 302*e* is a lost frame. In this case the G.711(A1) algorithm proceeds to regenerate (or synthesise) the missing frame 302*e* as described below (with reference to both FIGS. 2 and 3).

At a step S200, the pitch period of the audio data 304 that have been received (in the frames 302*a-d*) is estimated. The pitch period of audio data is the position of the maximum value of autocorrelation, which in the case of speech signals corresponds to the inverse of the fundamental frequency of the voice. However, this definition as the position of the maximum value of autocorrelation applies to both voice and non-voice data.

To estimate the pitch period, a normalised cross-correlation is performed of the most recent received 20 ms (160 samples) of audio data 304 (i.e. the 20 ms of audio data 304 just prior to current lost frame 302*e*) at taps from 5 ms (40 samples back from the current lost frame 302*e*) to 15 ms (120 samples back from the current lost frame 302*e*). In FIG. 3, an arrow 306 depicts the most recent 20 ms of audio data 304 and an arrow 308 depicts the range of audio data 304 against which this most recent 20 ms of audio data 304 is cross-correlated. The peak of the normalised cross-correlation is determined, and this provides the pitch period estimate. In FIG. 3, a dashed line 310 indicates the length of the pitch period relative to the end of the most recently received frame 302*d*.

In some embodiments, this estimation of the pitch period is performed as a two-stage process. The first stage involves a coarse search for the pitch period, in which the relevant part of the most recent audio data undergoes a 2:1 decimation prior to the normalised cross-correlation, which results in an approximate value for the pitch period. The second stage involves a finer search for the pitch period, in which the normalised cross-correlation is perform (on the non-decimated audio data) in the region around the pitch period estimated by the coarse search. This reduces the amount of processing involved and increases the speed of finding the pitch period.

In other embodiments, the estimate of the pitch period is performed only using the above-mentioned coarse estimation.

It will be appreciated that other methods of estimating the pitch period can be used, as are well-known in this field of technology. For example, an average-magnitude-difference function could be used, which is well-known in this field of technology. The average-magnitude-difference function involves computing the sum of the magnitudes of the differences between the samples of a signal and the samples of a delayed version of that signal. The pitch period is then identified as occurring when a minimum value of this sum of differences occurs.

In order to avoid aliasing or other unwanted audio effects at the cross-over between the most recently received frame 302*d* and the regenerated frame 302*e*, at a step S202 an overlap-add (OLA) procedure is carried out. The audio data 304 of the most recently received frame 302*d* is modified by performing an OLA operation on its most recent ¼ pitch period. It will be appreciated that there are a variety of methods for, and options available for, performing this OLA operation. In one embodiment of the G.711(A1) algorithm, the most recent ¼ pitch period is multiplied by a downward sloping ramp, ranging from 1 to 0, (a ramp 312 in FIG. 3) and has added to it the most recent ¼ pitch period multiplied by an upward sloping ramp, ranging from 0 to 1 (a ramp 314 in FIG. 3). Whilst this embodiment makes use of triangular windows, other windows (such as Hanning windows) could be used instead.

The modified most recently received frame 302*d* is output instead of the originally received frame 302*d*. Hence, the output of this frame 302*d* preceding the current (lost) frame 302*e* must be delayed by a ¼ pitch period duration, so that the last ¼ pitch period of this most recently received frame 302*d* can be modified in the event that the following frame (frame 302*e* in FIG. 3) is lost. As the longest pitch period searched for is 120 samples, the output of the preceding frame 302*d* must be delayed by ¼×120 samples=30 samples (or 3.75 ms for 8 kHz sampled data). In other words, each frame 302 that is received must be delayed by 3.75 ms before it is output (to storage, for transmission, or to an audio port, for example).

To regenerate the lost frame 302*e*, at a step S204, the audio data 304 of the most recent pitch period is repeated as often as is necessary to fill the 10 ms of the lost frame 302*e*. The number of repetitions of the pitch period depends on the length of the frame 302*e* and the length of the pitch period. For example, if the pitch period is 50 samples long, then the audio data 304 within the most recently received pitch period is repeated 80/50=1.6 times to regenerate the lost frame 302*e*. The number of repetitions of the pitch period is the number required to span the length of the lost frame 302*e*.

Other proposed packet loss concealment algorithms involve regenerating a lost frame by using not only audio data from frames that have been received prior to the lost frame but also audio data from frames that have been received after the lost frame. Thus, these packet loss concealment algorithms also inherently impose a delay on the output of frames, as a regenerated frame cannot be output until a frame is received after the loss of frames.

Increasingly, there is a drive to decrease, or minimize, the delays introduced into audio processing paths. As more and more processing is applied to audio data, even small delays resulting from each processing step can compound to an unacceptably large delay of the audio data.

It is therefore an object of the present invention to provide a packet loss concealment algorithm that reduces, or minimizes, the delay introduced into the audio data.

SUMMARY OF THE INVENTION

According to an aspect of the invention, there is provided a method according to the accompanying claims.

According to another aspect of the invention, there is provided an apparatus according to the accompanying claims.

According to other aspects of the invention, there is provided a computer program, a storage medium and a transmission medium according to the accompanying claims.

Various other aspects of the invention are defined in the appended claims.

BRIEF DESCRIPTION OF THE DRAWINGS

Embodiments of the invention will now be described, by way of example only, with reference to the accompanying drawings, in which.

DETAILED DESCRIPTION OF EMBODIMENTS OF THE INVENTION

In the description that follows and in FIGS. 4-11, certain embodiments of the invention are described. However, it will be appreciated that the invention is not limited to the embodiments that are described and that some embodiments may not include all of the features that are described below. If will be evident, however, that various modifications and changes may be made herein without departing from the broader scope of the invention as set forth in the appended claims.

Figure 4:
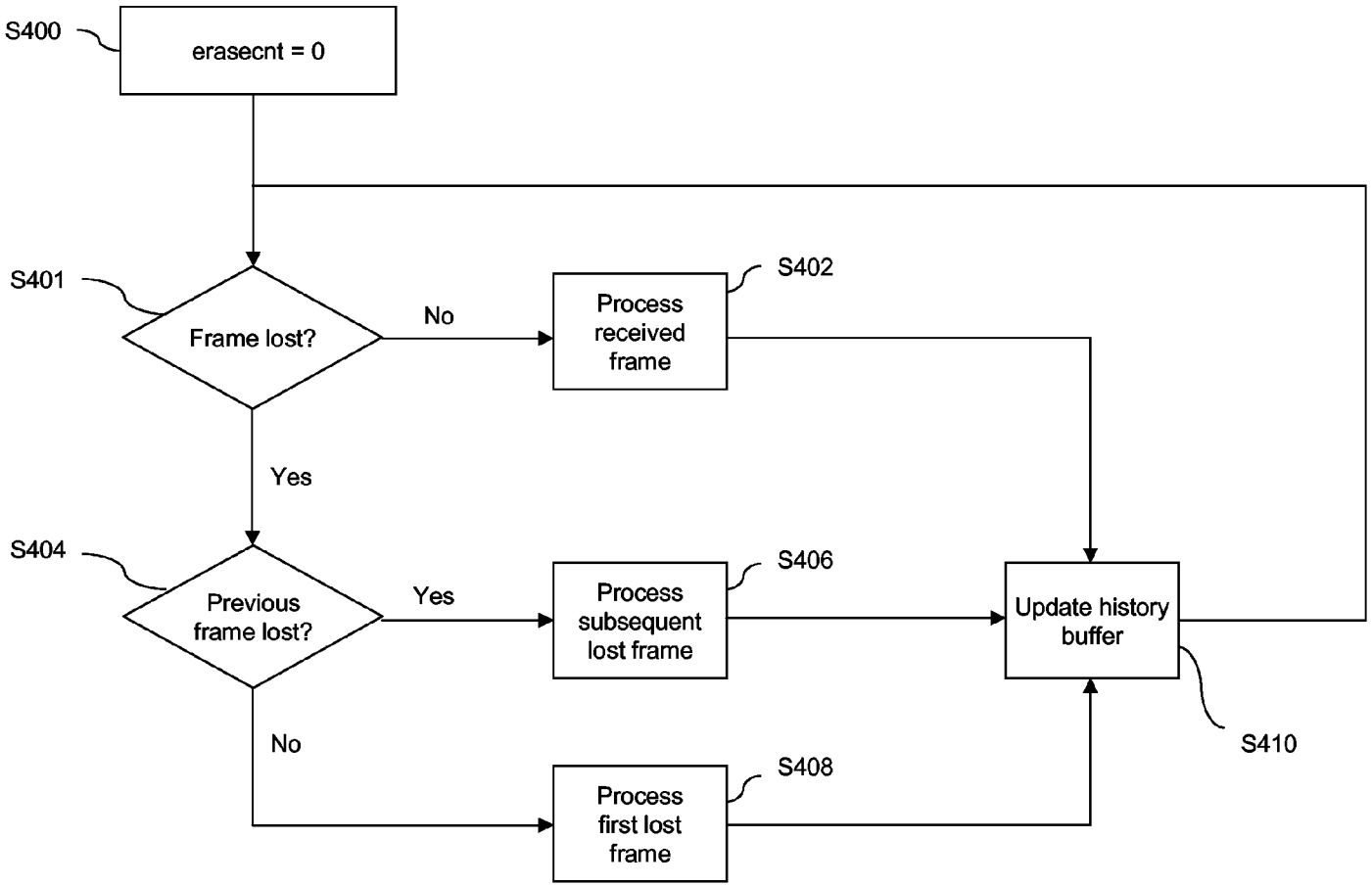
FIG. 4 is a flow chart schematically illustrating a high-level overview of a packet loss concealment algorithm according to an embodiment of the invention.

FIG. 4 is a flow chart schematically illustrating a high-level overview of a packet loss concealment algorithm according to an embodiment of the invention. The packet loss concealment algorithm according to an embodiment of the invention is a method of generating a frame of audio data for an audio signal from preceding audio data for the audio signal (the preceding audio data preceding the frame to be generated). Some embodiments of the invention are particularly suited to audio data representing voice data. Consequently, terms such as "pitch" and "pitch period" shall be used, which are commonly used in relation to voice signals. However, the definition of pitch period given above applies to both voice and non-voice signals and the description that follows is equally applicable to both voice and non-voice signals.

At a step S400, a counter erasecnt is initialised to be 0. The counter erasecnt is used to identify the number of consecutive frames that have been missed, or lost, or damaged or corrupted.

At a step S401, it is determined whether the current frame of audio data is lost (or missed, damaged or corrupted). The current frame of audio data may be, for example, 5 ms or 10 ms of audio data and may have been sampled at, for example, 8 kHz or 16 kHz. If it is determined that the current frame of audio data has been validly received, then processing continues at a step S402; otherwise, processing continues at a step S404.

At the step S402 (when the current frame has been received), the current received frame is processed, as will be described with reference to FIG. 8. Processing then continues at a step S410.

At the step S410, a history buffer is updated. The history buffer stores a quantity of the most recent audio data (be that received data or regenerated data). At the start of the processing for the current frame (whether or not that current frame has been received), the history buffer contains audio data for the preceding frames. The data for a current frame that has been received is stored initially in a separate buffer (an input buffer) and it is only stored into the history buffer once the processing for that current frame has been completed at the step S402. The use of the data stored in the history buffer will be described in more detail below.

Additionally, at the step S410, the current frame may be output to an audio port, stored, further processed, or transmitted elsewhere as appropriate for the particular audio application involved. Processing then returns to the step S401 in respect of the next frame (i.e. the frame following the current frame in the order of frames for the audio signal).

At the step S404 (when the current frame has been lost), it is determined whether the previous frame (i.e. the frame immediately preceding the current frame in the frame order) was also lost. If it is determined that the previous frame was also lost, then processing continues at a step S406; otherwise, processing continues at a step S408.

At the step S406, the lost frame is regenerated, as will be described with reference to FIG. 7. Processing then continues at the step S410.

At the step S408, the lost frame is regenerated, as will be described with reference to FIGS. 5 and 6. Processing then continues at the step S410.

Figure 3:
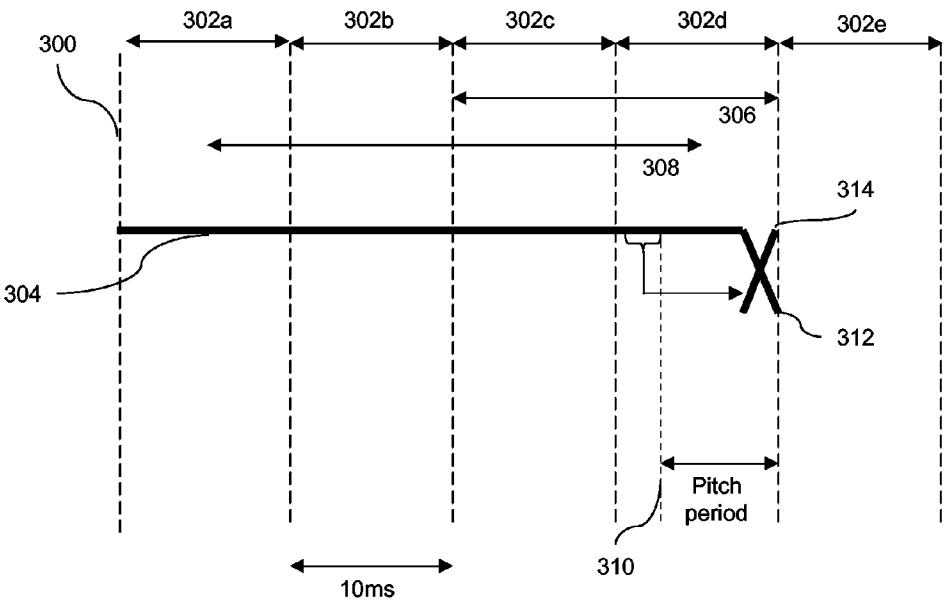
FIG. 3 is a schematic illustration of the audio data in the frames relevant for the processing performed in FIG. 2.
Figure 5:
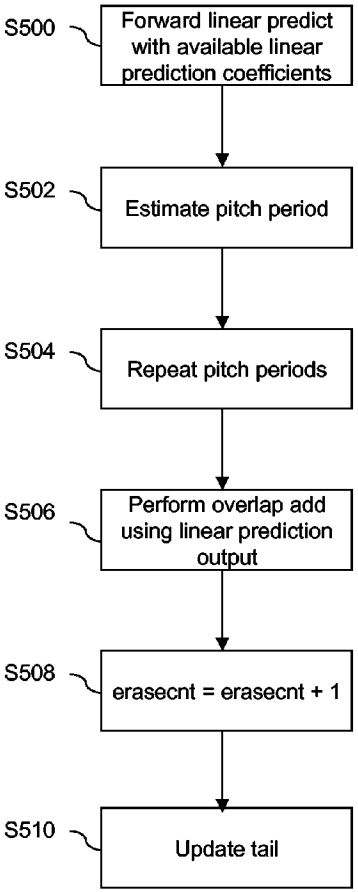
FIG. 5 is a flow chart schematically illustrating the processing performed according to an embodiment of the invention when the current frame has been lost, but the previous frame was not lost.

FIG. 5 is a flow chart schematically illustrating the processing performed at the step S408 of FIG. 4, i.e. the processing performed according to an embodiment of the invention when the current frame has been lost, but the previous frame was not lost. FIG. 6 is a schematic illustration of the audio data for the frames relevant for the processing performed in FIG. 5. This audio data is the audio data stored in the history buffer and may be either the data for received frames or data for regenerated frames, and the data may have undergone further audio processing (such as echo-cancelling, etc.) Some of the features of FIG. 6 are the same as those illustrated in FIG. 3 (and therefore use the same reference numeral), and they shall not be described again.

At a step S500, a prediction is made of what the first 16 samples of the lost frame 302*e* could have been. It will be appreciated that other numbers of samples may be predicted and that the number 16 is purely exemplary. Thus, at the step S500, a prediction of a predetermined number of data samples for the lost frame 302*e* is made, based on the preceding audio data 304 from the frames 302*a-d*.

The prediction performed at the step S500 may be achieved in a variety of way, using different prediction algorithms. However, in an embodiment, the prediction is performed using linear prediction. The prediction makes use of linear prediction coefficients (LPCs) $\{a(k)\}_{k=1 \ldots M}$. The actual LPCs used, and their generation, will be described in more detail later. In an embodiment, M=11, i.e. 11 LPCs are used. However, it will be appreciated that other numbers of LPCs may be used and that the number used may affect the quality of the predicted audio samples and the computation load imposed upon the system performing the packet loss concealment.

The linear prediction is achieved according to the equation below:

$$\hat{y}(n) = -\sum_{k=1}^{M} a(k)y(n-k)$$

where y(i) is the series of samples of the audio data 340 and $\hat{y}(n)$ represents the estimate of the actual value of the particular data sample y(n). Hence, in the above-mentioned embodiment in which 11 LPCs are used (M=11):

- the prediction of the first sample of the lost frame 302*e* uses the last 11 samples of the preceding received frame 302*d;*
- the prediction of the second sample of the lost frame 302*e* uses the last 10 samples of the preceding received frame 302*d* and the first predicted sample of the lost frame 302*e;*
- the prediction of the third sample of the lost frame 302*e* uses the last 9 samples of the preceding received frame 302*d* and the first two predicted samples of the lost frame 302*e;*
- and so on up to the prediction of the sixteenth sample of the lost frame 302*e.*

In other words, a predetermined number of data samples for the frame 302*e* are predicted based on the preceding audio data.

Figure 6:
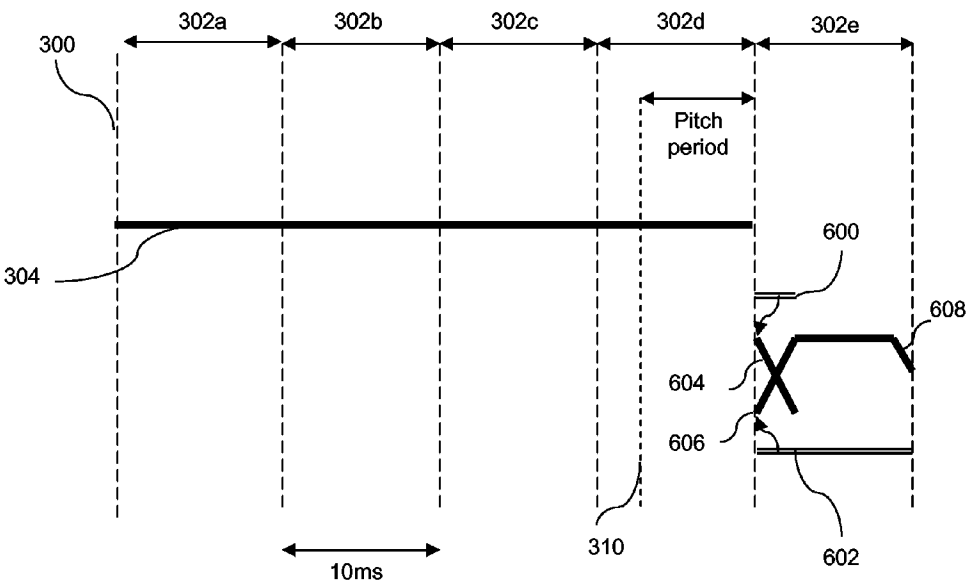
FIG. 6 is a schematic illustration of the audio data of the frames relevant for the processing performed in FIG. 5.

The predicted samples of the lost frame 302*e* are illustrated in FIG. 6 by a double line 600.

Figure 1:
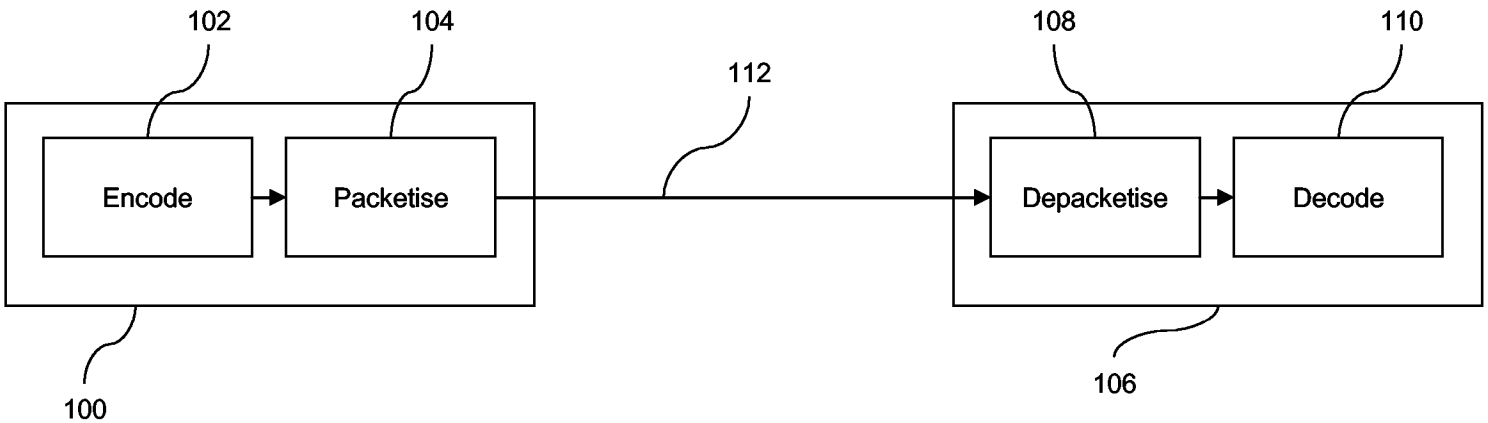
FIG. 1 schematically illustrates a typical audio transmitter/receiver system.
Figure 2:
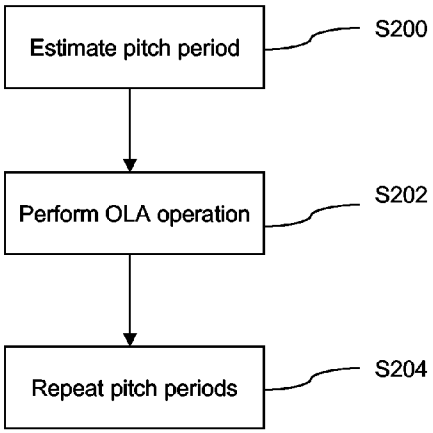
FIG. 2 is a flowchart showing the processing performed for the G.711(A1) algorithm when a first frame has been lost.

Next, at a step S502, the pitch period of the audio data 304 in the history buffer is estimated. This is performed in a similar manner to that described above for the step S200 of FIG. 2. In other words, a section (pitch period) of the preceding audio data is identified for use in generating the lost frame 302*e.*

Processing continues at a step S504, at which the audio data 304 in the history buffer is used to fill, or span, the length (10 ms) of the lost frame 302*e*. The audio data 304 used starts at an integer number, L, of pitch periods back from the end of the previous frame 302*d*. The value of the integer number L is the least positive integer such that L times the pitch period is at least the length of the frame 302*e*. For example, for frame lengths of 80 samples:

- if the pitch period is in the range 40-79 samples, then L=2; whilst
- if the pitch period is 80 samples or longer, then L=1.

In this way, preceding data samples 304 stored in the history buffer are repeated.

As an example, if the pitch period is 50 samples long and the frame length if 80 samples long, then L=2. In this case, the $100^{th}$ (=2×50) most recent sample 304 in the history buffer will be used for the first sample of the regenerated frame 302*e*; the $99^{th}$ most recent sample 304 in the history buffer will be used for the second sample of the regenerated frame 302*e*; and so on.

In this way, the steps S502 and S504 identify a section of the preceding audio data (a number L of pitch periods of data) for use in generating the lost frame 302*e*. The lost frame is then generated as a repetition of at least part of this identified section (as much data as is necessary to span the lost frame 302*e*).

As will be described below, a number of samples at the beginning of the lost frame 302*e* are generated using additional processing and hence the above repetition of data samples 304 may be omitted for these first number of samples. The repeated audio data 304 is illustrated in FIG. 6 by a double line 602. In FIG. 6, as the pitch period is less than the length of the frame 302*e*, the repeated audio data 304 is taken from 2 pitch periods back from the end of the preceding frame 302*d*.

In order to avoid aliasing or other unwanted audio effects (such as unnatural harmonic artefacts) at the cross-over between the most recently received frame 302*d* and the regenerated frame 302*e*, at a step S506 an overlap-add (OLA) procedure is carried out. The OLA procedure is carried out to generate the first 16 samples of the regenerated lost frame 302*e*. It will be appreciated that there are a variety of methods for, and options available for, performing this OLA operation. In an embodiment, the predicted samples (in this case, 16 predicted samples) are multiplied by a downward sloping ramp, ranging from 1 to 0 (illustrated as a ramp 604 in FIG. 6) and have added to them the corresponding number (16) of audio data samples of the repeated audio data 602 multiplied by an upward sloping ramp, ranging from 0 to 1, (illustrated as a ramp 606 in FIG. 6). Whilst this embodiment makes use of triangular windows, other windows (such as Hanning windows) could be used instead.

Thus:

- the beginning of the lost frame 302*e*, namely the first N (=16) samples of the regenerated lost frame 302*e*, comprises a combination (e.g. via an OLA operation) of the N (=16) predicted samples generated for the lost frame 302*e* and the a subset (the first N=16) samples from the repeated audio data 602; and
- the subsequent samples of the regenerated lost frame 302*e* are formed as the continuance of the repeated audio data 602.

It will be appreciated that the steps S502 and S504 could be performed before the step S500.

Next, at a step S508, the counter erasecnt is incremented by 1 to indicate that a frame has been lost.

Processing then continues at a step S510.

At an optional part of the step S510, a number of samples at the end of the regenerated lost frame 302*e* are faded-out by multiplying them by a downward sloping ramp ranging from 1 to 0.5. In an embodiment, the data samples involved in this fade-out are the last 8 data samples of the lost frame 302*e*. This is illustrated in FIG. 6 by a line 608. It will be appreciated that other methods of partially fading-out the regenerated lost frame 302*e* may be used, and may be applied over a different number of trailing samples of the lost frame 302*e*. Additionally, in some embodiments, this fading-out is not performed. However, by performing the fading-out, the frequencies at the end of the current lost frame 302*e* are slowly faded-out at the end of the current lost frame 302*e* and, as will be described below with reference to steps S706 and S806 in FIGS. 7 and 8, this fade-out will be continued in the next frame. This is done to avoid unwanted audio effects at the cross-over between the current frame and the next frame.

Additionally, at the step S510, a number of samples of the repeated data 602 that would follow on from the regenerated lost frame 302*e* are stored for use in processing the next frame. In one embodiment, this number is 8 samples, although it will be appreciated that other amounts may be stored. This audio data is referred to as the "tail" of the regenerated frame 302*e*. Its use shall be discussed in more detail later.

As an example, if the pitch period is 50 samples long and the frame length if 80 samples long, then L=2. In this case, the last sample of the regenerated frame 302*e* will be based on the $21^{st}$ most recent sample 304 in the history buffer. Then, the 8-sample tail comprises the $20^{th}$ through to the $13^{th}$ most recent samples 304 in the history buffer.

As another example, if the pitch period is 45 samples long and the frame length is 40 samples long, then L=1. In this case, the last sample of the regenerated frame 302*e* will be based on the $6^{th}$ most recent sample 304 in the history buffer. Then, the 8-sample tail comprises the $5^{th}$ through to the $1^{st}$ most recent samples 304 in the history buffer, together with the $1^{st}$ and $2^{nd}$ samples of the regenerated frame 302*e*.

It will therefore be appreciated that, when handling the first lost frame 302*e*, the embodiments of the present invention do not modify the frame 302*d* preceding the lost frame 302*e*. Hence, the preceding frame 302*d* does not need to be delayed, unlike in the G.711(A1) algorithm. In fact, the embodiments of the present invention have a 0 ms delay as opposed to the 3.75 ms delay of the G.711(A1) algorithm.

Figure 7:
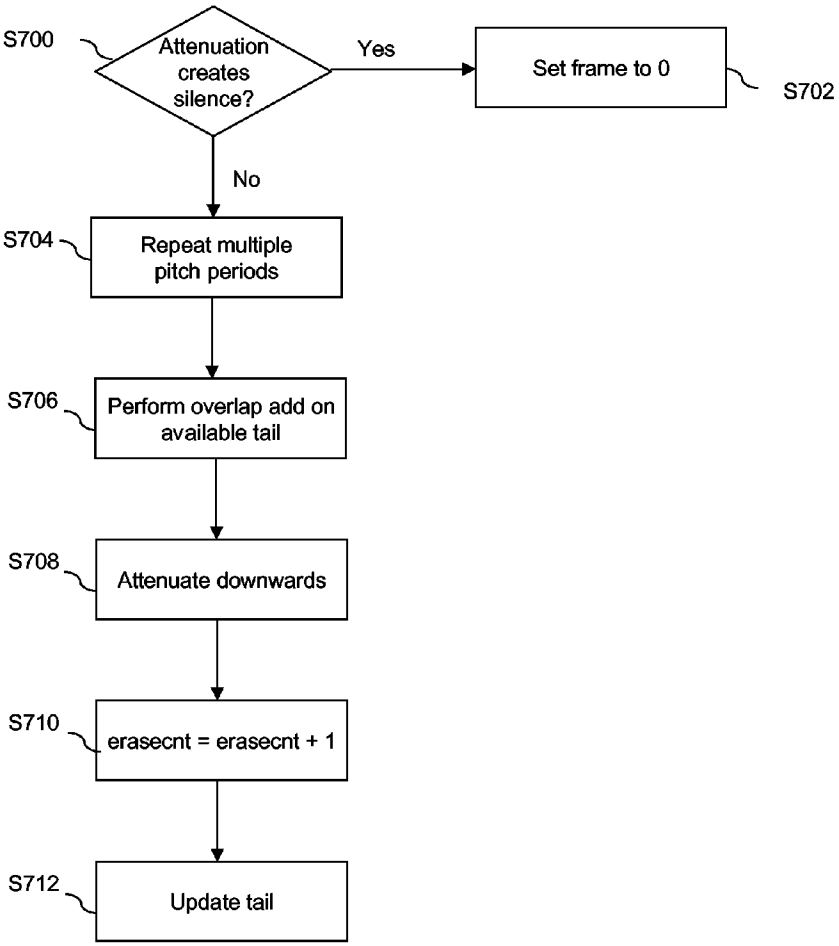
FIG. 7 is a flow chart schematically illustrating the processing performed according to an embodiment of the invention when the current frame has been lost and the previous frame was also lost.

FIG. 7 is a flow chart schematically illustrating the processing performed at the step S406 of FIG. 4, i.e. the processing performed according to an embodiment of the invention when the current frame has been lost and the previous frame was also lost.

When regenerating a second or further lost frame 302 in a series of consecutive lost frames, the second and further regenerated frames undergo progressively increasing degrees of attenuation (as will be described with respect to a step S708 later). Therefore, at a step S700, it is determined whether the attenuation to be performed when synthesising the current lost frame 302 would result in no sound at all (i.e. silence). If the attenuation would result in no sound at all, then processing continues at a step S702; otherwise, the processing continues at a step S704.

At the step S702 (the attenuation would result in no sound at all), the regenerated frame is set to be no sound, i.e. zero.

At the step S704 (the attenuation would not result in no sound at all), the number of pitch periods of the most recently received frames 302*a-d* that are used to regenerate the current lost frame 302 is changed. In one embodiment, the number of pitch periods used is as follows (where n a non-negative integer):

- for the (3n+1)-th lost frame, the number of pitch periods to be used is 1 (as was described with reference to the step S408 above for the first lost frame);
- for the (3n+2)-th lost frame, the number of pitch periods to be used is 3;
- for the (3n+3)-th lost frame, the number of pitch periods to be used is 2.

Then, the subsequent processing at the step S704 is the same as that of the step S504 in FIG. 5, except that the repetition of the data samples 304 is based on the initial assumption that the new number of pitch periods will be used, rather than the previous number of pitch periods. The repetition is commenced at the appropriate point (within the waveform of the new number of pitch periods) to continue on from the repetitions used to generate the preceding lost frame 302.

As mentioned above when describing the step S510, the tail for the first lost frame 302*e* was stored when the first lost frame 302*e* was regenerated. Additionally, as will be described later, at a step S712, the tail of the current lost frame 302 will also be stored. To ensure a smooth transition between the current lost frame 302 and the preceding regenerated lost frame 302, an overlap add procedure is performed. In an embodiment, the OLA procedure is carried out to generate the first 8 samples of the regenerated lost frame 302, although it will be appreciated that other numbers of samples at the beginning of the regenerated lost frame 302 may be regenerated by the OLA procedure. It will be appreciated that there are a variety of methods for, and options available for, performing this OLA operation. In an embodiment, the 8 samples from the stored tail are multiplied by a downward sloping ramp (the ramp decreasing from 0.5 to 0) and have added to them the first 8 samples of the repeated data samples multiplied by an upward sloping ramp (the ramp increasing from 0.5 to 1). Whilst this embodiment makes use of triangular windows, other windows (such as Hanning windows) could be used instead. Additionally, as mentioned, other sizes of the tail may be stored, so that the OLA operation may be performed to generate a different number of initial samples of the regenerated lost frame.

At a step S708, the audio data 304 for the current regenerated lost frame is attenuated downwards. The attenuation is performed at a rate of 20% per 10 ms of audio data 304, with the attenuation having begun at the second lost frame 302 of the series of consecutive lost frames. Thus, with frame sizes of 10 ms, the attenuation will result in no sound after 60 ms (i.e. the seventh lost frame 302 in the series of consecutive lost frames would have no sound). In this case, at the step S700, the processing would have continued to the step S702 at this seventh lost frame. With frame sizes of 5 ms, the attenuation will result in no sound after 55 ms (i.e. the twelfth lost frame 302 in the series of consecutive lost frames would have no sound). In this case, at the step S700, the processing would have continued to the step S702 at this twelfth lost frame.

However, it will be appreciated that different rates of attenuation may be used, and these may be linear or non-linear.

At the steps S710 and S712, the processing performed is the same as that performed at the steps S508 and S510 respectively.

Note that when the history buffer is updated at the step S410, it is updated with non-attenuated data samples from the regenerated frame 302. However, if silence is reached due to the attenuation, then the history buffer is reset at the step S410 to be all-zeros.

Figure 8:
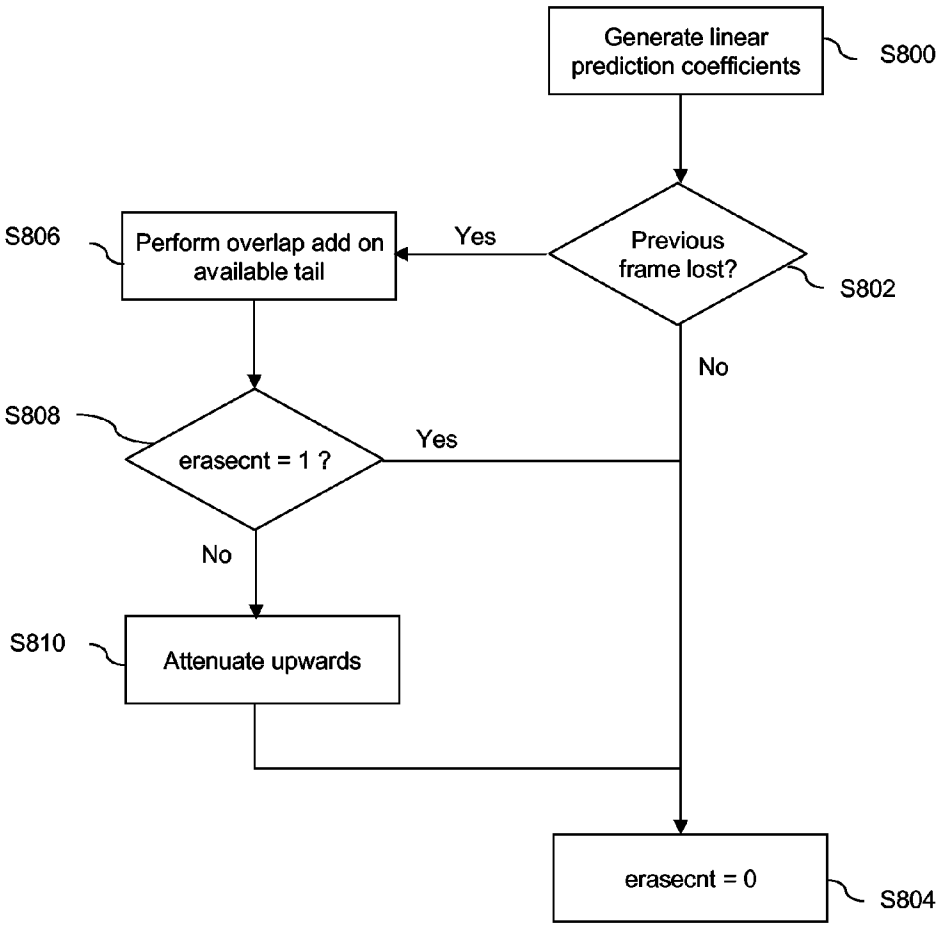
FIG. 8 is a flow chart schematically illustrating the processing performed according to an embodiment of the invention when the current frame has not been lost.

FIG. 8 is a flow chart schematically illustrating the processing performed at the step S402 of FIG. 4, i.e. the processing performed according to an embodiment of the invention when the current frame has not been lost.

At a step S800, the LPCs $\{a(k)\}_{k=1 \ldots M}$ are generated. This may be performed in a number of ways, many of which are known. In an embodiment of the invention, the LPCs can be generated using the autocorrelation method (which is well known in this field of technology) by solving the equation:

$$Ra=-r$$

where:

$a=[a(1), a(2), \ldots, a(M)]^T$ r(i)=autocorrelation of the audio data 340 in the history buffer with a delay of i $r=[r(1),r(2), \ldots, r(M)]^T$ and R is the M×M matrix with R(i,j)=r(i−j) and r(−i)=r(i) and r(i−j)=r(j−i) for all i and j $$\text{so that } R=\begin{pmatrix} r(0) & r(1) & r(2) & \cdots & r(M-1) \\ r(1) & r(0) & r(1) & \cdots & r(M-2) \\ r(2) & r(1) & r(0) & \cdots & r(M-3) \\ \vdots & \vdots & \vdots & \ddots & \vdots \\ r(M-1) & r(M-2) & r(M-3) & \cdots & r(0) \end{pmatrix}$$

This equation may be solved by finding the inverse of R and solving $a=-R^{-1}r$. However, to reduce the computational load, in an embodiment of the invention, the LPCs are generated by solving the equation.

$$\begin{pmatrix} r(0) & r(1) & r(2) & \cdots & r(M) \\ r(1) & r(0) & r(1) & \cdots & r(M-1) \\ r(2) & r(1) & r(0) & \cdots & r(M-2) \\ \vdots & \vdots & \vdots & \ddots & \vdots \\ r(M) & r(M-1) & r(M-2) & \cdots & r(0) \end{pmatrix} \begin{pmatrix} 1 \\ a(1) \\ a(2) \\ \vdots \\ a(M) \end{pmatrix} = \begin{pmatrix} E \\ 0 \\ 0 \\ 0 \\ 0 \end{pmatrix}$$

Although this equation can be solved in many ways, an embodiment of the present invention uses Levinson-Durbin recursion to solve this equation as this is particularly computationally efficient. Levinson-Durbin recursion is a well-known method in this field of technology (see, for example, "*Voice and Speech Processing*", T. W. Parsons, McGraw-Hill, Inc., 1987 or "*Levinson-Durbin Recursion*", Heeralal Choudhary, http://ese.wustl.edu/~choudhary.h/files/ldr.pdf).

In the above equation, the variable E is the energy of the prediction error, i.e. $E=\Sigma e_i^2$, where e is the prediction error signal. As is well-known, during the Levinson-Durbin recursion, different values for E ($E_0, E_1, \ldots$) are used at the various recursion steps, with the initial value being $E_0=r(0)$.

In the above, the autocorrelation values r(0), r(1), . . . , r(M) used can be calculated using any suitably sized window of samples, such as 160 samples.

Although these LPCs may never be needed (for example, if no frames are lost), the reason that they are calculated within the step S402 is that this spreads the computation load. The step S408, at which the LPCs are needed, is computationally intensive and hence, by having already calculated the LPCs in case they are needed, the processing at the step S408 is reduced. However, it will be appreciated that this step S800 could be performed during the step S408, prior to the step S500. Alternatively, the forward linear prediction performed at the step S500 could be performed as part of the step S404 for each frame 302 that is validly received, after the LPCs have been generated step at the S800. In this case, the step S408 would involve even further reduced processing.

Next, at a step S802, it is determined whether the previous frame 302 was lost. If the previous frame 302 was lost, then processing continues at a step S806; otherwise processing continues at a step S804.

At the step S804, the counter erasecnt is reset to 0, as there is no longer a sequence of lost frames 302.

To ensure a smooth transition between the previous frame 302, which was lost and has now been regenerated, and the currently received frame 302, an overlap add procedure is performed at the step S806. The processing performed at the step S806 is the same as that performed at the step S706.

Processing continues at a step S808, at which it is determined whether the sequence of lost frames 302 only involved a single frame 302, i.e. whether or not erasecnt=1. If the sequence of lost frames 302 only involved a single frame 302, then processing continues at the step S804; otherwise, processing continues at a step S810.

At the step S810, the audio data 304 for the received frame 304 is attenuated upwards. This is because downwards attenuation would have been performed at the step S708 for some of the preceding lost frames 302. In one embodiment of the present invention, the attenuation is performed across the full length of the frame (regardless of its length), linearly from the attenuation level used at the end of the preceding regenerated lost frame 302 up to 100%. However, it will be appreciated that other attenuation methods can be used. Processing then continues at the step S804.

Turning back to the history buffer, the history buffer is at least large enough to store the largest quantity of preceding audio data that may be required for the various processing that is to be performed. This depends, amongst other things on:

The amount of data required for the pitch-period estimation. Using the method described above in reference to the steps S200 and S502 for 8 kHz sampled data, the pitch period search cross-correlates 20 ms (160 samples) using taps from 40 samples up to 120 samples. Hence, at least 120+160=280 samples need to be stored in the history buffer.

The maximum number of pitch periods that may be needed to serve as the repeated data at the steps S704 and S504. In the above embodiments, this maximum number is 3 pitch periods, which may each be up to 120 samples long. Hence, at least 3×120=360 samples need to be stored in the history buffer.

The number of data samples required to determine the autocorrelations r(0), r(1), . . . , r(M). In the above embodiment, M=11 and a 160 sample window is used for the autocorrelation. Hence, at least 160+11=171 samples need to be stored in the history buffer.

Thus, in the above embodiment, the history buffer is 360 samples long. It will be appreciated, though, that the length of the history buffer may need changing for different sampling frequencies, different methods of pitch period estimation, and different numbers of repetitions of the pitch period.

It will be appreciated that it is desirable for packet loss concealment algorithms to generate as high a quality of regenerated audio as possible. Tests have shown that the above-mentioned embodiments of the invention perform favourably in objective quality tests. In particular, PESQ testing was performed according to the ITU-T P.862 standard (the entire disclosure of which is incorporated herein by reference). As is well known, PESQ objective quality testing provides a score, for most cases, in the range of 1.0 to 4.5, where 1.0 indicates that the processed audio is of the lowest quality and where 4.5 indicates that the processed audio is of the highest quality. (The theoretical range is from −0.5 to 4.5, but usual values start from 1.0)

Table 1 below provides results of testing performed on four standard test signals (phone_be.wav, tstseq1_be.wav, tstseq3_be.wav and u_af1s02_be.wav), using either 5 ms or 10 ms frames, with errors coming in bursts of one packet lost at a time, three packets lost at a time or eleven packets lost at a time, with the bursts having a 5% probability of appearance. As can be seen, embodiments of the invention perform at least comparably to the G.711(A1) algorithm in objective quality testing. Indeed, for most of the tests performed, the embodiments of the invention provide regenerated audio of a superior quality than that produced by the G.711(A1) algorithm.

TABLE 1

| Sequence name | Frame size (ms) | Error burst length (no. frames) | PESQ score using embodiment of invention | PESQ score using G.711(A1) algorithm | Difference |
|---|---|---|---|---|---|
| phone_be | 5 | 1 | 3.497 | 3.484 | 0.013 |
| | | 3 | 3.014 | 2.953 | 0.061 |
| | | 11 | 1.678 | 0.956 | 0.722 |
| | 10 | 1 | 3.381 | 3.399 | −0.018 |
| | | 3 | 2.750 | 2.719 | 0.031 |
| | | 11 | 0.793 | 0.813 | −0.020 |
| tstseq1_be | 5 | 1 | 3.493 | 3.419 | 0.074 |
| | | 3 | 3.141 | 2.815 | 0.326 |
| | | 11 | 1.859 | 1.458 | 0.401 |
| | 10 | 1 | 3.321 | 3.371 | −0.050 |
| | | 3 | 2.961 | 2.785 | 0.176 |
| | | 11 | 1.262 | 1.256 | 0.006 |
| tstseq3_be | 5 | 1 | 3.744 | 3.606 | 0.138 |
| | | 3 | 3.244 | 3.166 | 0.078 |
| | | 11 | 1.772 | 1.036 | 0.736 |
| | 10 | 1 | 3.388 | 3.294 | 0.094 |
| | | 3 | 3.032 | 2.872 | 0.160 |
| | | 11 | 0.917 | 1.012 | 0.095 |
| u_af1s02_be | 5 | 1 | 3.131 | 3.269 | −0.138 |
| | | 3 | 2.670 | 2.358 | 0.312 |
| | | 11 | 1.914 | 1.388 | 0.526 |
| | 10 | 1 | 3.365 | 3.386 | −0.021 |
| | | 3 | 2.670 | 2.566 | 0.104 |
| | | 11 | 1.459 | 1.551 | −0.092 |

Figure 9:
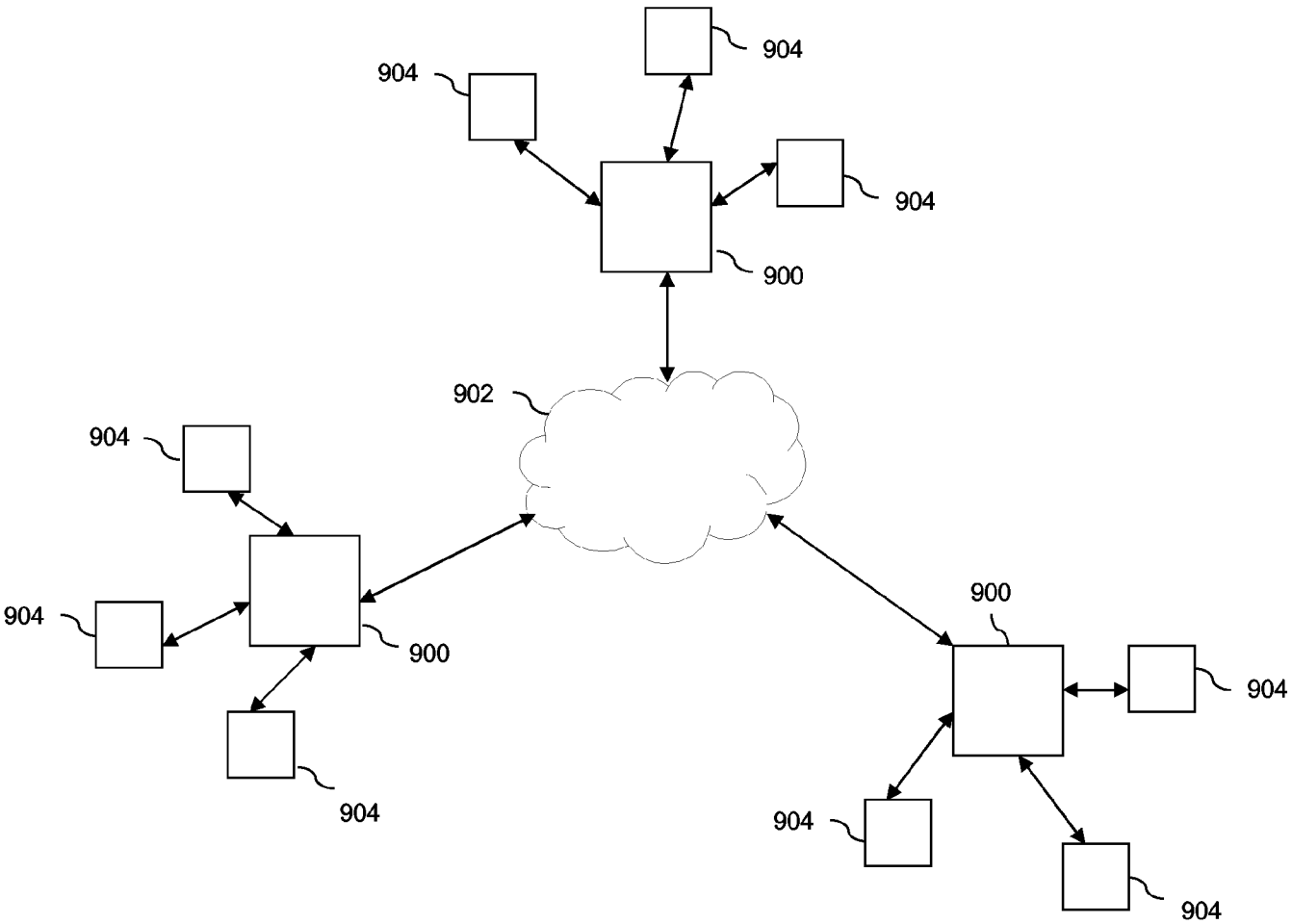
FIG. 9 schematically illustrates a communication system according to an embodiment of the invention.

FIG. 9 schematically illustrates a communication system according to an embodiment of the invention. A number of data processing apparatus 900 are connected to a network 902. The network 902 may be the Internet, a local area network, a wide area network, or any other network capable of transferring digital data. A number of users 904 communicate over the network 902 via the data processing apparatus 900. In this way, a number of communication paths exist between different users 904, as described below.

A user 904 communicates with a data processing apparatus 900, for example via analogue telephonic communication such as a telephone call, a modem communication or a facsimile transmission. The data processing apparatus 900 converts the analogue telephonic communication of the user 904 to digital data. This digital data is then transmitted over the network 902 to another one of the data processing apparatus 900. The receiving data processing apparatus 900 then converts the received digital data into a suitable telephonic output, such as a telephone call, a modem communication or a facsimile transmission. This output is delivered to a target recipient user 104. This communication between the user 904 who initiated the communication and the recipient user 904 constitutes a communication path.

As will be described in detail below, each data processing apparatus 900 performs a number of tasks (or functions) that enable this communication to be more efficient and of a higher quality. Multiple communication paths are established between different users 904 according to the requirements of the users 904, and the data processing apparatus 900 perform the tasks for the communication paths that they are involved in.

FIG. 9 shows three users 904 communicating directly with a data processing apparatus 900. However, it will be appreciated that a different number of users 904 may, at any one time, communicate with a data processing apparatus 900. Furthermore, a maximum number of users 904 that may, at any one time, communicate with a data processing apparatus 900, may be specified, although this may vary between the different data processing apparatus 900.

Figure 10:
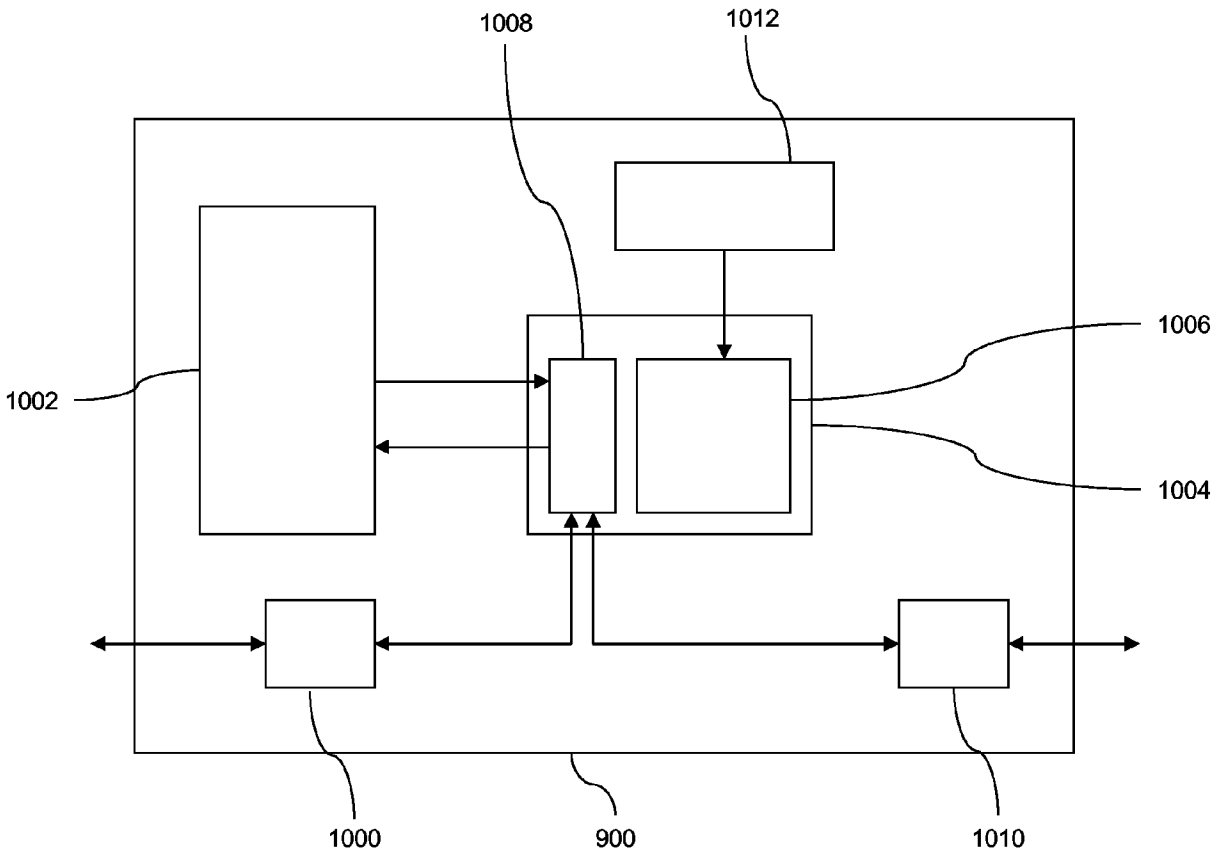
FIG. 10 schematically illustrates a data processing apparatus according to an embodiment of the invention.

FIG. 10 schematically illustrates the data processing apparatus 900 according to an embodiment of the invention.

The data processing apparatus 900 has an interface 1000 for interfacing with a telephonic network, i.e. the interface 1000 receives input data via a telephonic communication and outputs processed data as a telephonic communication. The data processing apparatus 900 also has an interface 1010 for interfacing with the network 902 (which may be, for example, a packet network), i.e. the interface 1010 may receive input digital data from the network 902 and may output digital data over the network 902. Each of the interfaces 1000, 1010 may receive input data and output processed data simultaneously. It will be appreciated that there may be multiple interfaces 1000 and multiple interfaces 1010 to accommodate multiple communication paths, each communication path having its own interfaces 1000, 1010.

It will be appreciated that the interfaces 1000, 1010 may perform various analogue-to-digital and digital-to-analogue conversions as is necessary to interface with the network 902 and a telephonic network.

The data processing apparatus 900 also has a processor 1004 for performing various tasks (or functions) on the input data that has been received by the interfaces 1000, 1010. The processor 1004 may be, for example, an embedded processor such as a MSC81x2 or a MSC711x processor supplied by Freescale Semiconductor Inc. Other digital signal processors may be used. The processor 1004 has a central processing unit (CPU) 1006 for performing the various tasks and an internal memory 1008 for storing various task related data. Input data received at the interfaces 1000, 1010 is transferred to the internal memory 1008, whilst data that has been processed by the processor 1004 and that is ready for output is transferred from the internal memory 1008 to the relevant interfaces 1000, 1010 (depending on whether the processed data is to be output over the network 902 or as a telephonic communication over a telephonic network).

The data processing apparatus 900 also has an external memory 1002. This external memory 1002 is referred to as an "external" memory simply to distinguish it from the internal memory 1008 (or processor memory) of the processor 1004.

The internal memory 1008 may not be able to store as much data as the external memory 1002 and the internal memory 1008 usually lacks the capacity to store all of the data associated with all of the tasks that the processor 1004 is to perform. Therefore, the processor 1004 swaps (or transfers) data between the external memory 1002 and the internal memory 1008 as and when required. This will be described in more detail later.

Finally, the data processing apparatus 900 has a control module 1012 for controlling the data processing apparatus 900. In particular, the control module 1012 detects when a new communication path is established, for example: (i) by detecting when a user 904 initiates telephonic communication with the data processing apparatus 900; or (ii) by detecting when the data processing apparatus 900 receives the initial data for a newly established communication path from over the network 902. The control module 1012 also detects when an existing communication path has been terminated, for example: (i) by detecting when a user 904 ends telephonic communication with the data processing apparatus 900; or (ii) by detecting when the data processing apparatus 900 stops receiving data for a current communication path from over the network 902.

When the control module 1012 detects that a new communication path is to be established, it informs the processor 1004 (for example, via a message) that a new communication path is to be established so that the processor 1004 may commence an appropriate task to handle the new communication path. Similarly, when the control module 1012 detects that a current communication path has been terminated, it informs the processor 1004 (for example, via a message) of this fact so that the processor 1004 may end any tasks associated with that communication path as appropriate.

The task performed by the processor 1004 for a communication path carries out a number of processing functions. For example, (i) it receives input data from the interface 1000, processes the input data, and outputs the processed data to the interface 1010; and (ii) it receives input data from the interface 1010, processes the input data, and outputs the processed data to the interface 1000. The processing performed by a task on received input data for a communication path may include such processing as echo-cancellation, media encoding and data compression. Additionally, the processing may include a packet loss concealment algorithm that has been described above with reference to FIGS. 4-8 in order to regenerate frames 302 of audio data 304 that have been lost during the transmission of the audio data 304 between the various users 904 and the data processing apparatus 900 over the network 902.

Figure 11:
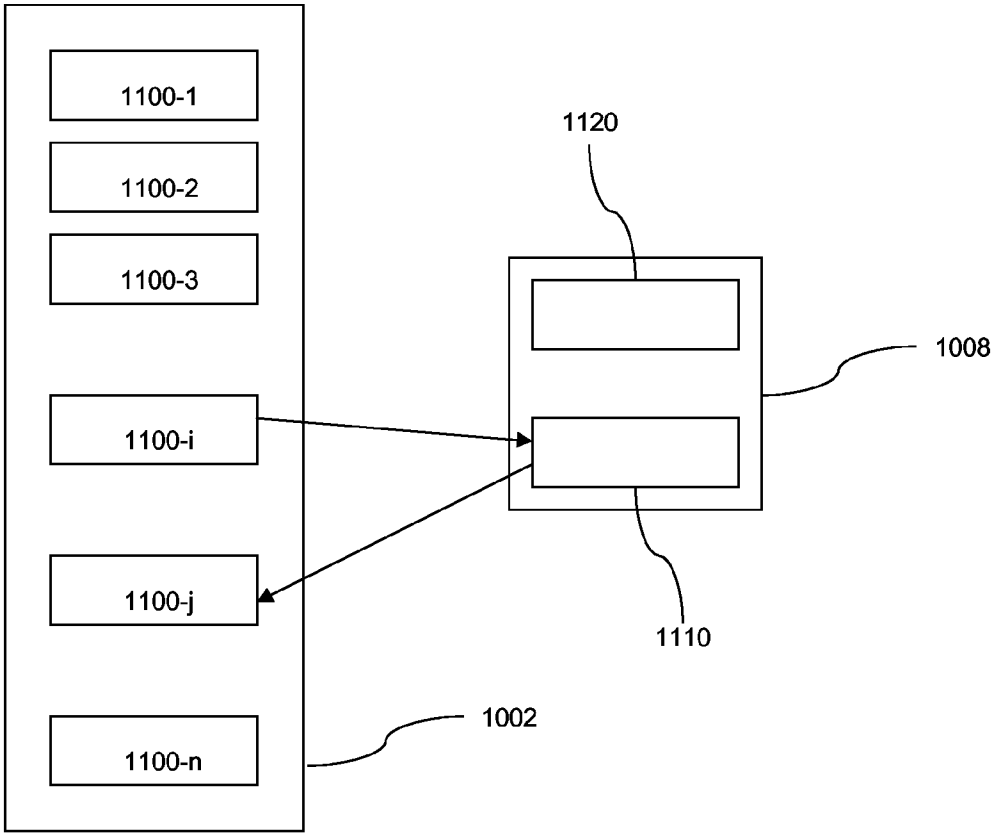
FIG. 11 schematically illustrates the relationship between an internal memory and an external memory of the data processing apparatus illustrated in FIG. 10.

FIG. 11 schematically illustrates the relationship between the internal memory 1008 and the external memory 1002.

The external memory 1002 is partitioned to store data associated with each of the communication paths that the data processing apparatus 900 is currently handling. As shown in FIG. 11, data 1100-1, 1100-2, 1100-3, **1100-*i*, 1100-*j* and 1100-*n*, corresponding to a 1st, 2nd, 3rd, i-th, j-th and n-th communication path, are stored in the external memory 1002. Each of the tasks that is performed by the processor 1004 corresponds to a particular communication path. Therefore, each of the tasks has corresponding data 1100 stored in the external memory 1002**.

Each of the data 1100 may be, for example, the data corresponding to the most recent 45 ms or 200 ms of communication over the corresponding communication path, although it will be appreciated that other amounts of input data may be stored for each of the communication paths. Additionally, the data 1100 may also include: (i) various other data related to the communication path, such as the current duration of the communication; or (ii) data related to any of the tasks that are to be, or have been, performed by the processor 1004 for that communication path (such as flags and counters). The data 1100 for a communication path comprises the history buffer used and maintained at the step S410 shown in FIG. 4, as well as the tail described above with reference to the steps S510, S706, S712 and S806.

As mentioned, the number, n, of communication paths may vary over time in accordance with the communication needs of the users 904.

The internal memory 1008 has two buffers 1110, 1120. One of these buffers 1110,1120 stores, for the current task being executed by the processor 1004, the data 1100 associated with that current task. In FIG. 11, this buffer is the buffer 1120. Therefore, in executing the current task, the processor 1004 will process the data 1100 being stored in the buffer 1120.

At the beginning of execution of the current task, the other one of the buffers 1110, 1120 (in FIG. 11, this buffer is the buffer 1110) stores the data 1100 that was processed by processor 1004 when executing the task preceding the current task. Therefore, whilst the current task is being executed by the processor 1004, the data 1100 stored in this other buffer 1110 is transferred (or loaded) to the appropriate location in the external memory 1002. In FIG. 11, the previous task was for the j-th communication path, and hence the data 1100 stored in this other buffer 1110 is transferred to the external memory 1002 to overwrite the data 1100-*j* currently being stored in the external memory 1002 for the j-th communication path and to become the new (processed) data 1100-*j* for the j-th communication path.

Once the transfer of the data 1100 in the buffer 1110 to the external memory 1002 has been completed, the processor 1004 determines which data 1100 stored in the external memory 1002 is associated with the task that is to be executed after the current task has been executed. In FIG. 11, the data 1100 associated with the task that is to be executed after the current task has been executed is the data 1100-*i* associated with the i-th communication path. Therefore, the processor 1004 transfers (or loads) the data 1100-*i* from the external memory 1002 to the buffer 1110 of the internal memory 1008.

In some embodiments of the invention, the data 1100 stored in the external memory 1002 is stored in a compressed format. For example, the data 1100 may be compressed and represented using the ITU-T Recommendation G.711 representation of the audio data 304 of the history buffer and the tail. This generally achieves a 2:1 reduction in the quantity of data 1100 to be stored in the external memory 1002. Other data compression techniques may be used, as a known in this field of technology. Naturally, the processor 1004 may wish to perform its processing on the non-compressed audio data 304, for example when performing the packet loss concealment algorithm according to embodiments of the invention. Thus, the processor 1004, having transferred compressed data 1100 from the external memory 1002 to the internal memory 1008, decompresses the compressed data 1100 to yield the non-compressed audio data 304 which can then be processed by the processor 1004 (for example, using the packet loss concealment algorithm according to an embodiment of the invention). After the audio data 304 has been processed, the audio data 304 is then re-compressed by the processor 1004 so that it can be transferred from the internal memory 1008 to the external memory 1002 for storage in the external memory 1002 in compressed form.

It will be appreciated that, in other embodiments of the invention, the section of audio data identified at the step S502 for use in generating the lost frame 302*e* may not necessarily be a single pitch period of data. Instead, an amount of audio data of a length of a predetermined multiple of pitch periods may be used. The predetermined multiple may or may not be an integer number.

Although OLA operations have been described as a method of combining data samples, it will be appreciated that other methods of combining data samples may be used, and some of these may performed in the time-domain, and others may involve transforming the audio data 304 into and out of the frequency domain.

Additionally, it will be appreciated that the entire beginning of the lost frame 302*e* does not need to be generated as a combination of the predicted data samples 600 and the repeated data samples 602. For example, the re-generated lost frame 302*e* could be re-generated using a number of the predicted data samples 600 (without combining with other samples), followed by a combination of predicted data samples 600 and a different subset of repeated data samples 602 (i.e. not the very initial data samples of the repeated data samples), followed then just by the repeated data samples 602.

Additionally, the prediction that has been described has been based on linear prediction using LPCs. However, this is purely exemplary and it will be appreciate that other forms of prediction of the data samples (such as non-linear prediction) of the lost frame 302*e* may be used. Whilst linear prediction using LPCs is particularly suited to voice-data, it can be used for non-voice data too. Alternative prediction methods for voice and/or non-voice audio data may be used instead of the above-described linear prediction.

According to an aspect of the invention, there is provided a method of generating a frame of audio data for an audio signal from preceding audio data for the audio signal that precede the frame of audio data, the method comprising the steps of: predicting a predetermined number of data samples for the frame of audio data based on the preceding audio data, to form predicted data samples; identifying a section of the preceding audio data for use in generating the frame of audio data; and forming the audio data of the frame of audio data as a repetition of at least part of the identified section to span the frame of audio data, wherein the beginning of the frame of audio data comprises a combination of a subset of the repetition of the at least part of the identified section and the predicted data samples.

According to another aspect of the invention, there is provided an apparatus adapted to carry out the above-mentioned method.

According to another aspect of the invention, there is provided a computer program, that when executed by a computer carries out the above-mentioned method.

It will be appreciated that, insofar as embodiments of the invention are implemented by a computer program, then a storage medium and a transmission medium carrying the computer program form aspects of the invention.

The invention claimed is:

1. A method of generating a frame of audio data for an audio signal from preceding audio data for the audio signal that precede the frame of audio data, the method comprising the steps of:

predicting at a processor a predetermined number of data samples for the frame of audio data based on the preceding audio data, to form predicted data samples, each predicted data sample being a linear combination of a predetermined number of audio data samples immediately preceding the frame;

identifying a section of the preceding audio data for use in generating the frame of audio data; and forming the audio data of the frame of audio data as a repetition of at least part of the identified section to span the frame of audio data, wherein the beginning of the frame of audio data comprises a combination of a subset of the repetition of the at least part of the identified section and the predicted data samples, wherein the subset of the at least part of the repetition of the identified section and the predicted data samples are combined by performing an overlap-add operation, and wherein the overlap-add operation comprises adding together the predicted data samples multiplied by a downward sloping ramp and the respective samples of the subset of the at least part of the repetition of the identified section multiplied by an upward sloping ramp.

2. A method according to claim 1, in which the step of identifying a section of the preceding audio data comprises the steps of:

estimating a pitch period of the preceding audio data; and identifying the section of the preceding audio data as the audio data immediately preceding the frame of audio data and having a length of a number of estimated pitch periods.

3. A method according to claim 2, in which the number of estimated pitch periods is 1.

4. A method according to claim 3, in which the pitch period is a position of the maximum value of autocorrelation of the preceding audio data.

5. A method according to claim 2, in which the number of estimated pitch periods is the least integer such that the combined length of the number of estimated pitch periods is at least the length of the frame of audio data.

6. A method according to claim 5, in which the pitch period is a position of the maximum value of autocorrelation of the preceding audio data.

7. A method according to claim 2, in which the pitch period is a position of the maximum value of autocorrelation of the preceding audio data.

8. A method according to claim 1, in which the step of predicting a predetermined number of data samples for the frame of audio data based on the preceding audio data comprises:

generating linear prediction coefficients based on the preceding audio data; and performing a linear prediction using the linear prediction coefficients.

9. A method according to claim 1, in which the preceding audio data is a predetermined quantity of the audio data for the audio signal immediately preceding the frame of audio data.

10. A method of receiving an audio signal, comprising the steps of:

receiving audio data for the audio signal;

determining whether a frame of audio data has been validly received;

if the frame of the audio data has not been validly received, generating the frame of the audio data using a method according to claim 1.

11. A method according to claim 10, in which the frame of audio data has not been validly received if it has been lost, missed, corrupted or damaged.

12. A non-transitory data carrying medium carrying a computer program that when executed by a computer, carries out a method of generating a frame of audio data for an audio signal from preceding audio data for the audio signal that precede the frame of audio data, the method comprising the steps of:

predicting a predetermined number of data samples for the frame of audio data based on the preceding audio data, to form predicted data samples, each predicted data sample being a linear combination of a predetermined number of audio data samples immediately preceding the frame;

identifying a section of the preceding audio data for use in generating the frame of audio data; and forming the audio data of the frame of audio data as a repetition of at least part of the identified section to span the frame of audio data, wherein the beginning of the frame of audio data comprises a combination of a subset of the repetition of the at least part of the identified section and the predicted data samples, wherein the subset of the at least part of the repetition of the identified section and the predicted data samples are combined by performing an overlap-add operation, and wherein the overlap-add operation comprises adding together the predicted data samples multiplied by a downward sloping ramp and the respective samples of the subset of the at least part of the repetition of the identified section multiplied by an upward sloping ramp.

* * * * *